US010287693B1

(12) United States Patent
Gilliam et al.

(10) Patent No.: US 10,287,693 B1
(45) Date of Patent: May 14, 2019

(54) ELECTROCHEMICAL SYSTEMS AND METHODS

(71) Applicant: Calera Corporation, Moss Landing, CA (US)

(72) Inventors: Ryan J Gilliam, San Jose, CA (US); Michael Kostowskyj, Los Gatos, CA (US); Thomas H McWaid, Santa Cruz, CA (US); Samaresh Mohanta, Dublin, CA (US); Hong Zhao, Marina, CA (US)

(73) Assignee: Calera Corporation, Moss Landing, CA (US)

( * ) Notice: Subject to any disclaimer, the term of this patent is extended or adjusted under 35 U.S.C. 154(b) by 0 days.

(21) Appl. No.: 16/196,199

(22) Filed: Nov. 20, 2018

Related U.S. Application Data

(62) Division of application No. 15/071,648, filed on Mar. 16, 2016, now Pat. No. 10,161,050.

(60) Provisional application No. 62/133,777, filed on Mar. 16, 2015.

(51) Int. Cl.

| | |
|---|---|
| ***C25B 9/00*** | (2006.01) |
| ***C25B 9/08*** | (2006.01) |
| ***C25B 13/04*** | (2006.01) |
| ***C25B 13/02*** | (2006.01) |
| ***C25B 9/06*** | (2006.01) |

(52) U.S. Cl.
CPC ..... *C25B 9/00* (2013.01); *C25B 9/063* (2013.01); *C25B 9/08* (2013.01); *C25B 13/02* (2013.01); *C25B 13/04* (2013.01)

(58) Field of Classification Search
CPC .. C25B 9/00; C25B 9/08; C25B 9/063; C25B 13/04; C25B 13/02; H01M 8/20; H01M 8/0293; H01M 8/188
USPC ..... 205/770
See application file for complete search history.

(56) References Cited

U.S. PATENT DOCUMENTS

| | | | | |
|---|---|---|---|---|
| 2006/0115710 | A1* | 6/2006 | Kusakabe ..... | H01M 8/0247 429/437 |
| 2011/0287336 | A1* | 11/2011 | Himeno ..... | H01M 8/0213 429/492 |
| 2015/0311541 | A1* | 10/2015 | Lloyd ..... | H01M 8/1023 429/509 |

* cited by examiner

*Primary Examiner* — Michael Bernshteyn
(74) *Attorney, Agent, or Firm* — Calera Corporation; Vandana Bansal

(57) ABSTRACT

Disclosed herein are ion exchange membranes, electrochemical systems, and methods that relate to various configurations of the ion exchange membranes and other components of the electrochemical cell.

10 Claims, 6 Drawing Sheets

ELECTROCHEMICAL SYSTEMS AND METHODS

CROSS-REFERENCE TO RELATED APPLICATIONS

This application is a divisional of a U.S. patent application Ser. No. 15/071,648, filed Mar. 16, 2016, now U.S. Pat. No. 10,161,050, which application claims benefit to U.S. Provisional Patent Application No. 62/133,777, filed Mar. 16, 2015, which is incorporated herein by reference in its entirety in the present disclosure.

GOVERNMENT SUPPORT

Work described herein was made in whole or in part with Government support under Award Number: DE-FE0002472 awarded by the Department of Energy. The Government has certain rights in this invention.

BACKGROUND

Electrochemical cells contain ion exchange membranes such as anion or cation exchange membranes interposed between the anode and the cathode. The membranes are ionic, porous and facilitate certain ions to pass through the membranes. Often, the membranes are pressed between the electrodes and need to be stiff and strong in order to withstand the temperature, pressure, and liquid flow conditions. Therefore, there is a need for membranes with mechanical strength and that improve electrochemical cell performance.

SUMMARY

In one aspect, there is provided an ion exchange membrane (IEM), comprising an ionomer membrane with a built-in separator wherein one or more sections of the built-in separator protrude out from at least one surface of the ionomer membrane. In some embodiments of the foregoing aspect, the one or more sections of the built-in separator protrude out from front and/or back surfaces of the ionomer membrane. In some embodiments of the foregoing aspect and embodiments, the amplitude of the protrusion is between about 0.01 mm-1 mm. In some embodiments of the foregoing aspect and embodiments, the wavelength of the amplitude of the protrusion is between about 0.5 mm-50 mm. In some embodiments of the foregoing aspect and embodiments, an average thickness of the ionomer membrane is between about 10 um-250 um. In some embodiments of the foregoing aspect and embodiments, the built-in separator is a mesh, cloth, foam, sponge, a planar mesh formed by the overlapping or stacked planes of interwoven fibers or screens, a mattress formed by coils of fibers, an expanded sheet, a plurality of sieves, a plurality of baffles or a plurality of cascading steps, or combinations thereof. In some embodiments of the foregoing aspect and embodiments, ratio of cross-sectional area of the built-in separator to the nominal cross-sectional area of the IEM is between about 5-70%. In some embodiments of the foregoing aspect and embodiments, an average thickness of the built-in separator is between about 20 um-2000 um.

In some embodiments of the foregoing aspect and embodiments, the built-in separator is made of material selected from the group consisting of polymer, fabric, and glass fibers. In some embodiments of the foregoing aspect and embodiments, the protrusion has a repeating pattern. In some embodiments of the foregoing aspect and embodiments, the protrusions are equidistant from each other. In some embodiments of the foregoing aspect and embodiments, the IEM is anion exchange membrane (AEM) and/or cation exchange membrane (CEM). In some embodiments of the foregoing aspect and embodiments, the built-in separator is configured to separate the IEM from an anode; separate the IEM from a cathode; separate the IEM from another IEM; or combinations thereof.

In some embodiments of the foregoing aspect and embodiments, the IEM further comprises a gasket material integrated with the IEM. In some embodiments of the foregoing aspect and embodiments, the gasket material is integrated to the edges of the IEM. In some embodiments of the foregoing aspect and embodiments, the gasket material is integrated on front, back, or both sides of the IEM. In some embodiments of the foregoing aspect and embodiments, the gasket material is of thickness between about 0.01 mm-5 mm. In some embodiments of the foregoing aspect and embodiments, the gasket material is made of silicone, viton, rubber, cork, felt, foam, plastic, fiber glass, flexible graphite, mica, or polymer. In some embodiments of the foregoing aspect and embodiments, the polymer is polypropylene, polyethylene, polyethylene teraphthalate, nylon, polytetrafluoroethylene, polychlorotrifluoroethylene, polyvinylidene fluoride, polyvinyl chloride, ethylene propylene, ethylene propylenediene, neoprene, or urethane. In some embodiments of the foregoing aspect and embodiments, the gasket material is a design selected from flat sheet or cord sheet.

In one aspect, there is provided an electrochemical method, comprising:

applying a voltage between an anode and a cathode;

contacting the anode with an anode electrolyte wherein the anode electrolyte comprises metal ions and the anode oxidizes the metal ions from a lower oxidation state to a higher oxidation state;

contacting the cathode with a cathode electrolyte;

contacting the anode electrolyte with an ion exchange membrane (IEM) comprising an ionomer membrane with a built-in separator and/or contacting the cathode electrolyte with an IEM comprising an ionomer membrane with a built-in separator, wherein one or more sections of the built-in separator protrude out from at least one surface of the IEM.

In some embodiments of the foregoing aspect, the built-in separator provides rigidity to the IEM and eliminates a need for an additional separator component. In some embodiments of the foregoing aspect and embodiments, the one or more sections of the built-in separator protrude out from front and/or back surfaces of the IEM. In some embodiments of the foregoing aspect and embodiments, the amplitude of the protrusion is between about 0.01 mm-1 mm. In some embodiments of the foregoing aspect and embodiments, the built-in separator separates the IEM from the anode; separates the IEM from the cathode; separates the IEM from another IEM; or combinations thereof. In some embodiments of the foregoing aspect and embodiments, the method further comprises integrating a gasket material to the IEM. In some embodiments of the foregoing aspect and embodiments, the method further comprises integrating the gasket material by screen printing, bonding through ultrasonic welding or heat, dipping, polymerization, injection molding, extruding, 3D printing, or digital printing. In some embodiments of the foregoing aspect and embodiments, the gasket material integrated to the IEM imparts rigidity and strength to the IEM and eliminates a need for a separate gasket component.

BRIEF DESCRIPTION OF THE DRAWINGS

The novel features of the invention are set forth with particularity in the appended claims. A better understanding of the features and advantages of the present invention may be obtained by reference to the following detailed description that sets forth illustrative embodiments, in which the principles of the invention are utilized, and the accompanying drawings of which:

DETAILED DESCRIPTION

Figure 1:
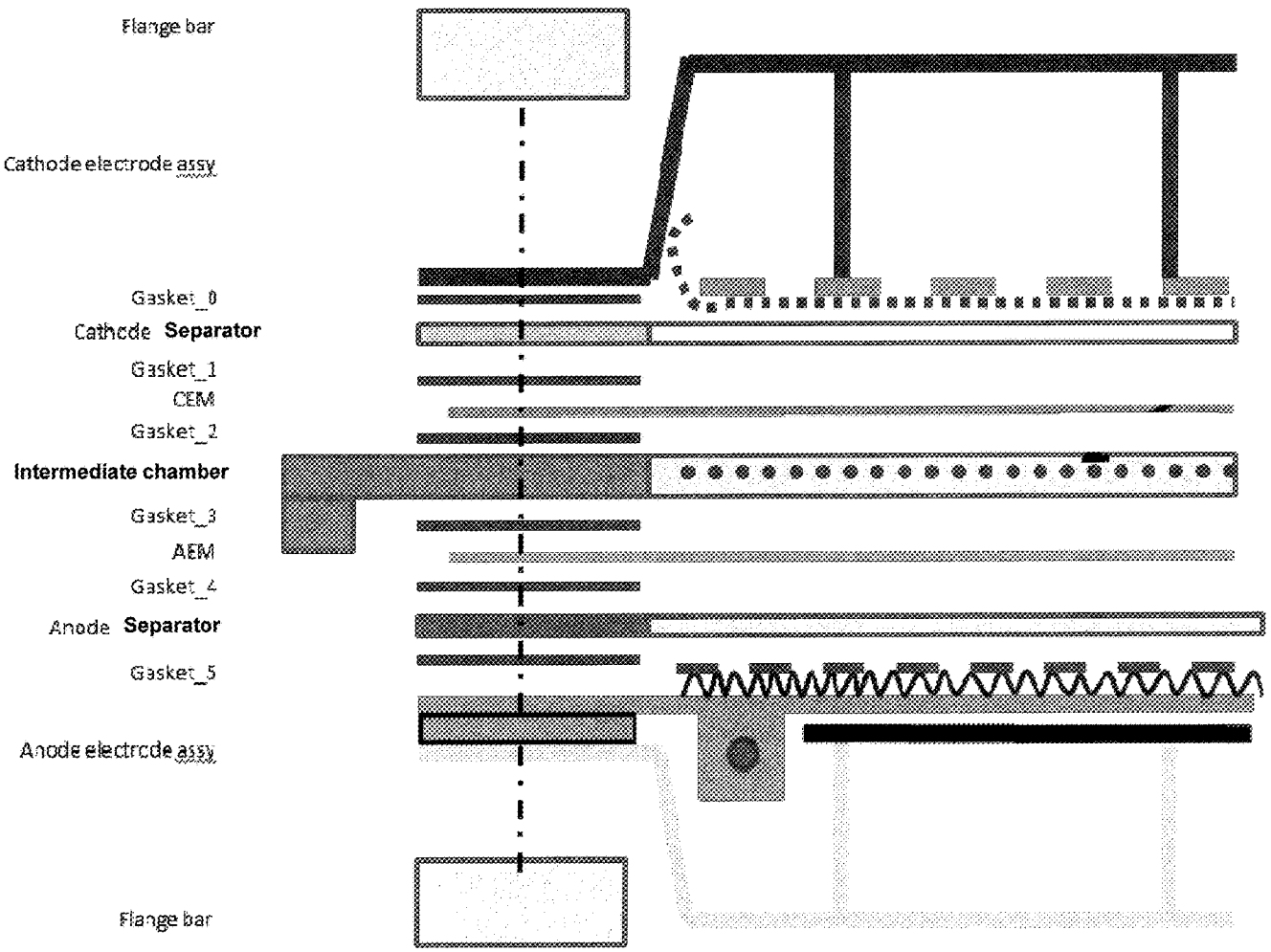
FIG. 1 is an illustration of some embodiments related to an electrolyzer.

Disclosed herein are ion exchange membranes, electrochemical systems, and methods of using and making the same, that may improve the performance of the membrane and/or the electrochemical cell.

Before the present invention is described in greater detail, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Certain ranges that are presented herein with numerical values may be construed as "about" numericals. The "about" is to provide literal support for the exact number that it precedes, as well as a number that is near to or approximately the number that the term precedes. In determining whether a number is near to or approximately a specifically recited number, the near or approximating unrequited number may be a number, which, in the context in which it is presented, provides the substantial equivalent of the specifically recited number.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It is noted that, as used herein and in the appended claims, the singular forms "a," "an," and "the" include plural references unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

Membranes, Electrochemical Systems, and Methods

In a typical electrochemical system, there is an anode chamber that houses an anode and an anode electrolyte. There is a cathode chamber that houses a cathode and a cathode electrolyte and the anode chamber and the cathode chamber are separated by an ion exchange membrane (IEM). The IEM may be an anion exchange membrane (AEM), a cation exchange membrane (CEM), or both depending on the desired reactions at the anode and the cathode. In some electrolyzers, the electrochemical system includes the anode and the cathode separated by both the AEM and the CEM creating a third chamber in the middle containing a third electrolyte. In between these components, various additional separator components may be provided to separate, e.g. the AEM from the anode, the CEM from the cathode and/or AEM from the CEM as well as provide mechanical integrity to the membranes. The space created by these separator components also facilitates flow of the electrolyte resulting in better current flow as well as prevent the membranes from touching other components that may lead to warping and fouling. In addition to these components, an individual gasket frame may be provided in between the components to seal the compartments from fluid leakage and to prevent friction between the components when pressure is applied to the electrochemical cell (e.g. in filter press design).

For example, FIG. 1 illustrates a cross-sectional view of the electrolyzer with a multiplicity of the individual components. As illustrated in FIG. 1, between the anode electrode assembly and the cathode electrode assembly, there may be upwards of 10 components that may need to be aligned including the IEMs, the separators, and the gaskets. It is apparent from FIG. 1, how obtaining a required planarity and parallelism of the cathode, anode, gaskets, separators, membranes, and the intermediate chamber, can present a remarkable difficulty during assembly and operation. During the assembly of the electrolyzer, the staff must position all the components sequentially including the positioning of the separators on the membranes and appropriate gasket components between each component. Among the difficulties of such an assembly sequence include the tendency of the separators to slide downwards during the vertical positioning and the necessity of keeping the components mutually aligned as minimal misalignment or the sliding downwards can give result in in-homogeneity of the current distribution leading to negative effects on the electrode, membranes, and the separators. Moreover, in the case of malfunctioning of even one component, every component of the entire electrolyzer will have to be taken apart and assembled again which may lead to additional damage during handling.

Applicants have discovered a novel way to reduce the number of individual separator components and gasket components in the electrochemical cell that not only improves the ease of assembly but also the longevity and performance of the components of the cell.

Applicants have devised an IEM that has an ionomer membrane integrated with a built-in separator such that the built-in separator serves a dual purpose of providing mechanical integrity or reinforcement to the IEM as well as creating a separation space between the IEM and the other components in the cell. This configuration eliminates the need for individual membrane and separator components as well as improves the performance of the membrane and the cell (also demonstrated in Example 2 herein).

In some embodiments, Applicants have found novel ways to attach the separator component to the IEM (in this embodiment the separator is not built-in to the IEM but is attached to the IEM) and/or attach gasket material to one or more components of the electrochemical cell in order to reduce the number of individual components in the cell and to provide mechanical integrity to the components.

All of such configurations related to the IEM comprising ionomer membrane and the built-in separator; an IEM comprising the separator attached to the ion exchange membrane; and the gasket material attached to the individual components of the electrochemical cell, have been described herein below.

Ion Exchange Membrane with Built-in Separator

In one aspect, there is provided an ion exchange membrane (IEM), comprising an ionomer membrane with a built-in separator wherein one or more sections of the built-in separator protrude out from at least one surface of the ionomer membrane.

The ion exchange membrane (IEM) may be an anion exchange membrane (AEM) or a cation exchange membrane (CEM). The "ion exchange membrane," or "IEM," or "AEM," or "CEM," as used herein, includes conductive polymeric membrane made of ionomers. The IEMs transport ions across the conductive polymeric membranes. Anion exchange membranes contain fixed cationic groups with mobile anions; they allow the passage of anions and block cations. Cation exchange membranes contain fixed anionic groups with mobile cations; they allow the passage of cations and block anions. The conductive polymeric membrane of the IEM is made from ionomers and is "ionomer membrane" herein. The "ionomer" as used herein includes a polymer comprising ionized units bonded to the polymeric backbone. The "built-in separator" as used herein, includes any separator that is integrated or incorporated in the ionomer membrane to form the IEM such that one or more sections of the built-in separator protrude out from at least one surface of the ionomer membrane. The built-in separator integrated with the ionomer membrane provides reinforcement or mechanical support to the IEM as well as separate the IEM from adjacent components via protrusions of the built-in separator. The built-in separator also reduces the solution resistance by enhancing the mixing of the liquid flow at the ionomer membrane surface, breaking the boundary layer, and improving the transport of the ions across the ionomer membrane (described in detail herein below). The "separator" as used herein, includes any porous substance suitable for being readily traversed or permeated by a liquid flow. Examples of ionomer membranes and built-in separators have been provided herein.

Figure 2A:
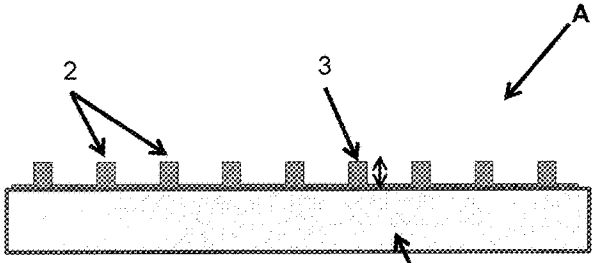
FIGS. 2A-F illustrate some embodiments related to an ion exchange membrane (IEM) comprising an ionomer membrane with a built-in separator.
Figure 2B:
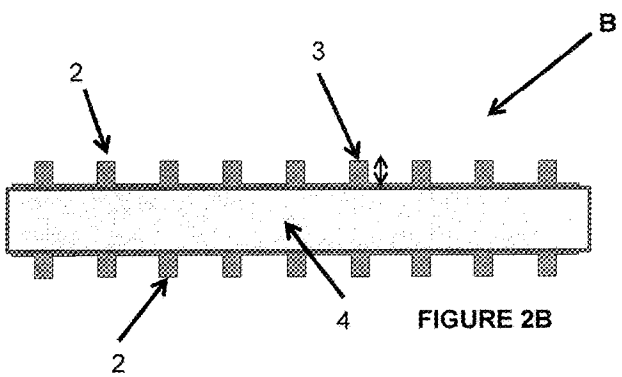

An example of the IEM comprising the ionomer membrane with the built-in separator wherein one or more sections of the built-in separator protrude out from at least one surface of the ionomer membrane, is provided in FIGS. 2A-2F. A cross-sectional view of an IEM A illustrated in FIG. 2A comprises a built-in separator 2 and the ionomer membrane 4. The one or more sections of the built-in separator that protrude out from one surface of the ionomer membrane are illustrated as 3 in FIG. 2A. While FIG. 2A illustrates an IEM where the one or more sections of the built-in separator are protruding out from one side of the ionomer membrane, FIG. 2B illustrates a cross-sectional view of an IEM B where the one or more sections of the built-in separator 2 are protruding out 3 from both side of the ionomer membrane 4. Accordingly, in some embodiments of the above noted aspect, there is provided an IEM wherein the one or more sections of the built-in separator protrude out from front and/or back surfaces of the ionomer membrane. It is to be understood that FIGS. 2A and 2B are for illustration only and merely represent an example of the IEM and the built-in separator. Other configurations of the built-in separator, such as other designs, protrusion, and frequency of the protrusion may vary and all are within the scope of the invention.

Figure 2C:
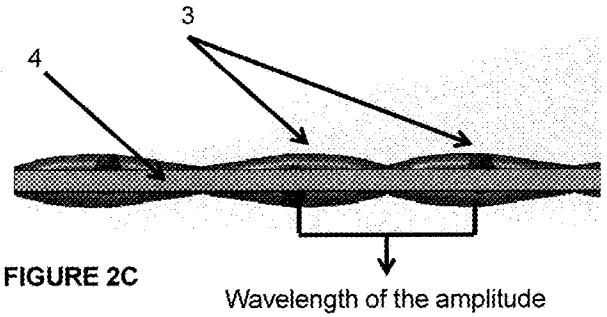
Figure 2D:
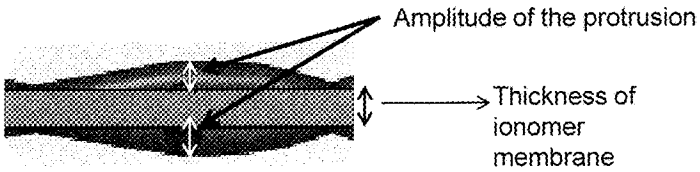

FIG. 2C illustrates another example of a cross-sectional view of the IEM (as illustrated in FIG. 2B) comprising an ionomer membrane 4 with a built-in separator wherein one or more sections of the built-in separator protrude out 3 from front and back surfaces of the ionomer membrane. The amplitude of the protrusion is illustrated in an exploded view in FIG. 2D. The amplitude of the protrusion is measured from the ionomer membrane surface to the farthest exposed location of the built-in separator (shown by double arrow in FIG. 2D). In some embodiments of the foregoing aspect and embodiments, the amplitude of the protrusion is between about 0.01 mm-2 mm. In some embodiments of the foregoing aspect and embodiments, the amplitude of the protrusion is between about 0.01 mm-2 mm; or between about 0.05 mm-2 mm; or between about 0.07 mm-2 mm; or between about 0.09 mm-2 mm; or between about 0.1 mm-2 mm; or between about 0.5 mm-2 mm; or between about 0.8 mm-2 mm; or between about 1 mm-2 mm; or between about 0.01 mm-1 mm; or between about 0.05 mm-1 mm; or between about 0.07 mm-1 mm; or between about 0.09 mm-1 mm; or between about 0.1 mm-1 mm; or between about 0.5 mm-1 mm; or between about 0.8 mm-1 mm; or between about 0.01 mm-0.5 mm; or between about 0.05 mm-0.5 mm; or between about 0.07 mm-0.5 mm; or between about 0.09 mm-0.5 mm; or between about 0.1 mm-0.5 mm; or between about 0.3 mm-0.5 mm; or between about 0.01 mm-0.3 mm; or between about 0.05 mm-0.3 mm; or between about 0.07 mm-0.3 mm; or between about 0.09 mm-0.3 mm; or between about 0.1 mm-0.3 mm; or between about 0.2 mm-0.3 mm; or between about 0.01 mm-0.1 mm; or between about 0.03 mm-0.1 mm; or between about 0.04 mm-0.1 mm; or between about 0.05 mm-0.1 mm; or between about 0.06 mm-0.1 mm; or between about 0.07 mm-0.1 mm; or between about 0.08 mm-0.1 mm; or between about 0.09 mm-0.1 mm. In some embodiments of the foregoing aspect and embodiments, the amplitude of the protrusion is between about 0.01 mm-2 mm, or between about 0.01 mm-1 mm, or between about 0.01 mm-0.5 mm, or between about 0.01 mm-0.3 mm, or between about 0.01 mm-0.1 mm.

In some embodiments of the foregoing aspect and embodiments, the one or more sections of the built-in separator protrude out with different amplitudes of the protrusion on the two ionomer membrane surfaces. In some embodiments, the amplitude of the protrusion is same on both top and bottom surfaces of the ionomer membrane. In some embodiments, the amplitude of the protrusion is different on the top and bottom surfaces of the ionomer membrane. For example, in some embodiments, the amplitude of the protrusion from the top surface of the ionomer membrane is more than the amplitude of the protrusion from the bottom surface of the ionomer membrane, or vice versa.

In some embodiments of the foregoing aspect and embodiments, the wavelength (or pitch) of the protrusion or the wavelength of the amplitude of the protrusion, i.e. peak to peak of the amplitude of the protrusion (as illustrated in FIG. 2C) is between about 0.5 mm-50 mm. The wavelength of the protrusion includes pitch of the protrusion when the built-in separator has a non-woven structure.

In some embodiments of the foregoing aspect and embodiments, the built-in separator may be a woven structure or a non-woven structure. For example, the built-in separator is a mesh, cloth, foam, sponge, a planar mesh formed by the overlapping or stacked planes of interwoven fibers or screens, a mattress formed by coils of fibers, an expanded sheet, a plurality of sieves, a plurality of baffles or a plurality of cascading steps, or combinations thereof.

Figure 2E:
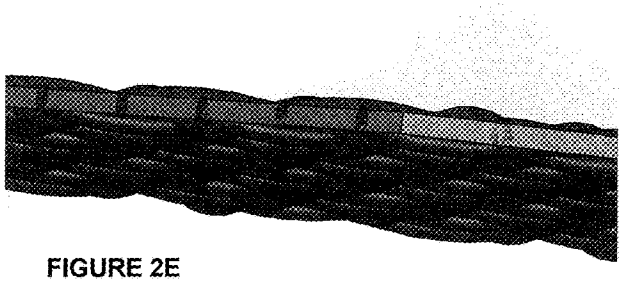
Figure 2F:
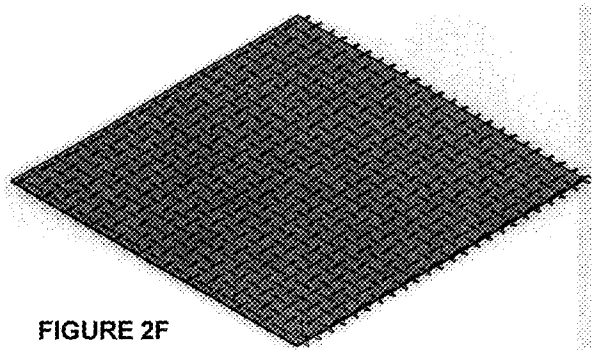

In embodiments where the built-in separator is a woven structure, a fiber or sheet may follow a sort of sinusoidal path (noted as wavelength above) as it passes over one perpendicular fiber or sheet, and then under another. The fiber may protrude from the ionomer membrane in the vicinity of each maximum and minimum along the length of the fiber. An example of the woven structure of the built-in separator is illustrated in FIGS. 2C-2F. FIGS. 2E and 2F illustrate an example of a back view and a top view respectively, of the ionomer membrane integrated with the built-in separator where the built-in separator is a mesh such as a woven mesh. In embodiments where the built-in separator is a non-woven structure, examples include without limitation, foam, sponge, expanded sheet, stacks of sieves or baffles; the non-woven structure may comprise a regular array of protruding features (noted as pitch above). An example of the non-woven structure of the built-in separator is illustrated in FIGS. 2A-2B. For example, the protrusions in the non-woven structure may be the walls of openings of an expanded sheet, or may be the walls separating adjacent pores of either the foam or an etched baffle sheet. Each of those protrusions is separated from its immediate neighboring protrusions by a distance, which may be called pitch.

In some embodiments, the built-in separator has a repeating or recurring pattern of the protrusions (not random) whether it has the woven or the non-woven structure. The repeating or the recurring pattern of the structure can be seen in the repeating backbone structure of the built-in separator. The wavelength or the pitch of the protrusions may also reflect the repeating pattern of the protrusions of the built-in separator. For example, when the built-in separator is a mesh, as shown in FIG. 2F, the mesh has the repeating or recurring pattern to the structure such that the protrusions are equidistant from each other. Similarly, FIG. 2A or 2B illustrates a non-woven structure such as the walls of openings of the expanded sheet, or the walls separating adjacent pores of either the foam or an etched baffle sheet, where the protrusions are equidistant from each other. In some embodiments, this repeating or recurring structure of the built-in separator may result in equidistant ionomer membrane between the protrusions. These equidistant protrusions due to the repeating or the recurring pattern may provide substantially equal mechanical strength through the entire length of the IEM as well as keep the entire IEM at substantially an equal distance from other components in the cell.

In some embodiments of the foregoing aspect and embodiments, the wavelength (or the pitch) of the protrusion is between about 0.5 mm-50 mm; or between about 1 mm-50 mm; or between about 2 mm-50 mm; or between about 5 mm-50 mm; or between about 10 mm-50 mm; or between about 15 mm-50 mm; or between about 25 mm-50 mm; or between about 35 mm-50 mm; or between about 45 mm-50 mm; or between about 0.5 mm-30 mm; or between about 1 mm-30 mm; or between about 2 mm-30 mm; or between about 5 mm-30 mm; or between about 10 mm-30 mm; or between about 15 mm-30 mm; or between about 25 mm-30 mm; or between about 0.5 mm-25 mm; or between about 1 mm-25 mm; or between about 2 mm-25 mm; or between about 5 mm-25 mm; or between about 10 mm-25 mm; or between about 15 mm-25 mm; or between about 0.5 mm-15 mm; or between about 1 mm-15 mm; or between about 2 mm-15 mm; or between about 5 mm-15 mm; or between about 10 mm-15 mm; or between about 0.5 mm-10 mm; or between about 1 mm-10 mm; or between about 2 mm-10 mm; or between about 5 mm-10 mm; or between about 0.5 mm-5 mm; or between about 0.6 mm-5 mm; or between about 0.8 mm-5 mm; or between about 1 mm-5 mm; or between about 2 mm-5 mm; or between about 3 mm-5 mm; or between about 4 mm-5 mm; or between about 0.5 mm-3 mm; or between about 0.6 mm-3 mm; or between about 0.8 mm-3 mm; or between about 1 mm-3 mm; or between about 2 mm-3 mm; or between about 0.5 mm-2 mm; or between about 0.6 mm-2 mm; or between about 0.8 mm-2 mm; or between about 1 mm-2 mm. In some embodiments of the foregoing aspect and embodiments, the wavelength of the protrusion is between about 0.5 mm-10 mm, or between about 0.5 mm-5 mm, or between about 1 mm-5 mm.

In some embodiments, the built-in separator has hydrophobic characteristics or hydrophilic characteristics as is suitable for the cell. In some embodiments of the foregoing aspect and embodiments, the built-in separator is made of material selected from, but not limited to, polymer, fabric, glass fibers, and the like. The separator may be a corrosion resistant plastic material, such as, for example, a perfluorinated material, e.g., poly-tetrafluoroethylene (PTFE). Other examples of polymer include, without limitation, polyethylene, polypropylene, polyether ether ketone, polyethylene terephthalate, and the like.

The built-in separators may have high strength even at low thickness, high crease/crack resistance and/or high tear strength. The built-in separators may be substantially chemically resistant to acids, bases, free radicals and/or metal ions and may be thermally and hydrolytically stable from temperatures of about 50° C. to 200° C. In some embodiments, the built-in separator may be thermally and hydrolytically stable to temperatures of at least about 90° C. The built-in separators may also possess mechanical properties (such as tensile strength), dimensional stability, and barrier properties (to metal ions, water vapor, gases such as oxygen, hydrogen, etc.) even at elevated temperatures and pressures.

In some embodiments of the foregoing aspect and embodiments, an average thickness of the built-in separator and an average thickness of the ionomer membrane individually may be the same or different depending on the desired configuration of the IEM. For example, the IEM illustrated in FIG. 2A may have the same thickness of the ionomer membrane and the built-in separator but the built-in separator is integrated in the ionomer membrane in such a way that the built-in separator has one or more sections protruding out of the ionomer membrane. In some embodiments, an average thickness of the built-in separator is more than an average thickness of the ionomer membrane such that when integrated, the built-in separator protrudes or projects outward from the ionomer membrane (e.g. FIG. 2B). An example of the built-in separator of varying thickness compared to the ionomer membrane is also illustrated in FIG. 2E. Whether the thickness of the built-in separator is same as the ionomer membrane or different, the IEM formed by the integration of the two, will always have one or more sections of the built-in separator protruding out from the top and/or bottom surface of the ionomer membrane, in accordance with the invention.

In some embodiments of the foregoing aspect and embodiments, an average thickness of the ionomer membrane in the IEM provided herein is between about 10 um-250 um. In some embodiments of the foregoing aspect and embodiments, the average thickness of the ionomer membrane is between about 10 um-250 um; or between about 20 um-250 um; or between about 50 um-250 um; or between about 75 um-250 um; or between about 100 um-250 um; or between about 150 um-250 um; or between about 200 um-250 um; or between about 10 um-200 um; or between about 20 um-200 um; or between about 50 um-200 um; or between about 75 um-200 um; or between about 100 um-200 um; or between about 150 um-200 um; or between about 10 um-150 um; or between about 20 um-150 um; or between about 50 um-150 um; or between about 75 um-150 um; or between about 100 um-150 um; or between about 125 um-150 um; between about 10 um-100 um; or between about 20 um-100 um; or between about 50 um-100 um; or between about 75 um-100 um; between about 10 um-50 um; or between about 20 um-50 um; or between about 25 um-50 um; or between about 30 um-50 um; or between about 40 um-50 um; between about 10 um-25 um; or between about 20 um-25 um; or between about 10 um-20 um; or between about 10 um-15 um. In some embodiments of the foregoing aspect and embodiments, the average thickness of the ionomer membrane is between about 20 um-50 um; or between about 25 um-50 um; or between about 30 um-50 um; or between about 40 um-50 um.

In some embodiments of the foregoing aspect and embodiments, the average thickness of the built-in separator in the IEM provided herein is between about 20 um-2000 um (or 0.02 mm-2 mm). In some embodiments, where the built-in separator is the woven or the non-woven structure with protrusions projected outwards from the surface of the ionomer membrane, the thickness of the built-in separator is an average thickness since the built-in separator has maximums and minimums along the length of the built-in separator when it has the woven structure and has the regular array of the protrusions when it has the non-woven structure. In some embodiments of the foregoing aspect and embodiments, the average thickness of the built-in separator is between about 20 um-100 um; or between about 50 um-100 um; or between about 75 um-100 um; or between about 20 um-200 um; or between about 50 um-200 um; or between about 100 um-200 um; or between about 150 um-200 um; or between about 20 um-250 um; or between about 50 um-250 um; or between about 75 um-250 um; or between about 100 um-250 um; or between about 150 um-250 um; or between about 200 um-250 um; or between about 20 um-500 um; or between about 50 um-500 um; or between about 100 um-500 um; or between about 250 um-500 um; or between about 20 um-750 um; or between about 100 um-750 um; or between about 250 um-750 um; or between about 500 um-750 um; or between about 20 um-1000 um; or between about 50 um-1000 um; or between about 100 um-1000 um; or between about 250 um-1000 um; or between about 500 um-1000 um; or between about 750 um-1000 um; or between about 20 um-1500 um; or between about 100 um-1500 um; or between about 500 um-1500 um; or between about 1000 um-1500 um; or between about 20 um-2000 um; or between about 100 um-2000 um; or between about 200 um-2000 um; or between about 500 um-2000 um; or between about 1000 um-2000 um; or between about 1500 um-2000 um. In some embodiments of the foregoing aspect and embodiments, the average thickness of the built-in separator is between about 20 um-2000 um; or between about 20 um-1500 um; or between about 20 um-1000 um; or between about 20 um-500 um; or between about 20 um-250 um.

In some embodiments of the foregoing aspect and embodiments, the structure of the built-in separator is sufficiently open or porous so that it is readily traversed and/or permeated by the liquid flow. In some embodiments, the IEM comprising the ionomer membrane and the built-in separator is not dependent on the concentration gradient or is not diffusion limited for the transport of the ions across the ionomer membrane. In some embodiments, the built-in separator facilitates access of the liquid flow to the ionomer membrane surface so that the ions are transported across the ionomer membrane convectively and are not diffusion controlled. This can greatly enhance the transport of the ions across the membrane. In some embodiments, the protrusions on the built-in separator provide mixing of the liquid flow (e.g. anolyte or catholyte or brine) as the liquid goes over the surface of the IEM thereby breaking the boundary layer of the ions at the ionomer membrane surface and improving the transport of ions. One or more of the foregoing advantages can reduce or minimize the through-plane area resistance of the IEM. The foregoing advantages can be seen in Example 2 herein.

In some embodiments of the foregoing aspect and embodiments, a ratio of cross-sectional area of the built-in separator to the nominal cross-sectional area of the IEM is between about 5-70%. In some embodiments of the foregoing aspect and embodiments, the ratio of the cross-sectional area of the built-in separator to the nominal cross-sectional area of the IEM is between about 5-70%; or between about 5-60%; or between about 5-50%; or between about 5-40%; or between about 5-30%; or between about 5-20%; or between about 5-10%; or between about 10-70%; or between about 10-60%; or between about 10-50%; or between about 10-40%; or between about 10-30%; or between about 10-20%; between about 20-70%; or between about 20-60%; or between about 20-50%; or between about 20-40%; or between about 20-30%; between about 5-20%; or between about 10-20%; or between about 5-10%. In some embodiments of the foregoing aspect and embodiments, the ratio of the cross-sectional area of the built-in separator to the nominal cross-sectional area of the IEM is between about 10-70%; or between about 10-60%; or between about 10-50%; or between about 10-40%; or between about 10-30%; or between about 10-20%. For example, if the ratio of the cross-sectional area of the built-in separator to the nominal cross-sectional area of the IEM is 5%, then 5% of the area of the IEM is the built-in separator and 95% of the area is the ionomer membrane.

In some embodiments, smaller ratio of the cross-sectional area of the built-in separator to the nominal cross-sectional area of the IEM provides higher ionomeric surface due to larger pores of or spaces in the built-in separator being filled by the ionomer membrane. For example, if the ratio of the cross-sectional area of the built-in separator to the nominal cross-sectional area of the IEM is 5%, the built-in separator has larger pore area that is filled with the ionomer membrane (about 95%) while still providing the protrusions as well as mechanical strength to the ionomer membrane.

In some embodiments, there is provided an IEM, comprising: an ionomer membrane with a built-in separator wherein one or more sections of the built-in separator protrude out from at least one surface of the ionomer membrane, wherein amplitude of the protrusion is between about 0.01 mm-2 mm; or between about 0.01 mm-1 mm; or between about 0.01 mm-0.5 mm, or between about 0.01 mm-0.1 mm. In some embodiments, there is provided an IEM, comprising: ionomer membrane with a built-in separator wherein one or more sections of the built-in separator protrude out from at least one surface of the ionomer membrane, wherein amplitude of the protrusion is between about 0.01 mm-2 mm; or between about 0.01 mm-1 mm; or between about 0.01 mm-0.5 mm, or between about 0.01 mm-0.1 mm, and wherein wavelength of the amplitude of the protrusion is between about 0.5 mm-50 mm; or between about 0.5 mm-10 mm; or between about 0.5 mm-5 mm.

In some embodiments, there is provided an IEM, comprising: an ionomer membrane with a built-in separator wherein one or more sections of the built-in separator protrude out from at least one surface of the ionomer membrane, wherein an average thickness of the ionomer membrane is between about 10 um-250 um; or between about 10 um-100 um; or between about 10 um-50 um; or between about 20 um-50 um.

In some embodiments, there is provided an IEM, comprising: an ionomer membrane with a built-in separator wherein one or more sections of the built-in separator protrude out from at least one surface of the ionomer membrane, wherein an average thickness of the ionomer membrane is between about 10 um-250 um; or between about 10 um-100 um; or between about 10 um-50 um; or between about 20 um-50 um, and wherein amplitude of the protrusion is between about 0.01 mm-2 mm; or between about 0.01 mm-1 mm; or between about 0.01 mm-0.5 mm, or between about 0.01 mm-0.1 mm.

In some embodiments, there is provided an IEM, comprising: an ionomer membrane with a built-in separator wherein one or more sections of the built-in separator protrude out from at least one surface of the ionomer membrane, wherein an average thickness of the ionomer membrane is between about 10 um-250 um; or between about 10 um-100 um; or between about 10 um-50 um; or between about 20 um-50 um, wherein amplitude of the protrusion is between about 0.01 mm-2 mm; or between about 0.01 mm-1 mm; or between about 0.01 mm-0.5 mm, or between about 0.01 mm-0.1 mm, and wherein wavelength of the amplitude of the protrusion is between about 0.5 mm-50 mm; or between about 0.5 mm-10 mm; or between about 0.5 mm-5 mm.

In some embodiments, there is provided an IEM, comprising: an ionomer membrane with a built-in separator wherein one or more sections of the built-in separator protrude out from at least one surface of the ionomer membrane, wherein a ratio of the cross-sectional area of the built-in separator to the nominal cross-sectional area of the IEM is between about 5-70%; or between about 5-50%; or between about 5-30%; or between about 10-30%.

In some embodiments, there is provided an IEM, comprising: an ionomer membrane with a built-in separator wherein one or more sections of the built-in separator protrude out from at least one surface of the ionomer membrane, wherein a ratio of the cross-sectional area of the built-in separator to the nominal cross-sectional area of the IEM is between about 5-70%; or between about 5-50%; or between about 5-30%; or between about 10-30%, and wherein amplitude of the protrusion is between about 0.01 mm-2 mm; or between about 0.01 mm-1 mm; or between about 0.01 mm-0.5 mm, or between about 0.01 mm-0.1 mm.

In some embodiments, there is provided an IEM, comprising: an ionomer membrane with a built-in separator wherein one or more sections of the built-in separator protrude out from at least one surface of the ionomer membrane, wherein a ratio of the cross-sectional area of the built-in separator to the nominal cross-sectional area of the IEM is between about 5-70%; or between about 5-50%; or between about 5-30%; or between about 10-30%, wherein amplitude of the protrusion is between about 0.01 mm-2 mm; or between about 0.01 mm-1 mm; or between about 0.01 mm-0.5 mm, or between about 0.01 mm-0.1 mm, and wherein wavelength of the amplitude of the protrusion is between about 0.5 mm-50 mm; or between about 0.5 mm-10 mm; or between about 0.5 mm-5 mm.

In some embodiments, there is provided an IEM, comprising: an ionomer membrane with a built-in separator wherein one or more sections of the built-in separator protrude out from at least one surface of the ionomer membrane, wherein a ratio of the cross-sectional area of the built-in separator to the nominal cross-sectional area of the IEM is between about 5-70%; or between about 5-50%; or between about 5-30%; or between about 10-30%, wherein an average thickness of the ionomer membrane is between about 10 um-250 um; or between about 10 um-100 um; or between about 10 um-50 um; between about 20 um-50 um.

In some embodiments, there is provided an IEM, comprising: an ionomer membrane with a built-in separator wherein one or more sections of the built-in separator protrude out from at least one surface of the ionomer membrane, wherein a ratio of the cross-sectional area of the built-in separator to the nominal cross-sectional area of the IEM is between about 5-70%; or between about 5-50%; or between about 5-30%; or between about 10-30%, wherein an average thickness of the ionomer membrane is between about 10 um-250 um; or between about 10 um-100 um; or between about 10 um-50 um; between about 20 um-50 um, and wherein amplitude of the protrusion is between about 0.01 mm-2 mm; or between about 0.01 mm-1 mm; or between about 0.01 mm-0.5 mm, or between about 0.01 mm-0.1 mm.

In some embodiments, there is provided an IEM, comprising: an ionomer membrane with a built-in separator wherein one or more sections of the built-in separator protrude out from at least one surface of the ionomer membrane, wherein a ratio of the cross-sectional area of the built-in separator to the nominal cross-sectional area of the IEM is between about 5-70%; or between about 5-50%; or between about 5-30%; or between about 10-30%, wherein an average thickness of the ionomer membrane is between about 10 um-250 um; or between about 10 um-100 um; or between about 10 um-50 um; between about 20 um-50 um, wherein amplitude of the protrusion is between about 0.01 mm-2 mm; or between about 0.01 mm-1 mm; or between about 0.01 mm-0.5 mm, or between about 0.01 mm-0.1 mm, and wherein wavelength of the amplitude of the protrusion is between about 0.5 mm-50 mm; or between about 0.5 mm-10 mm; or between about 0.5 mm-5 mm.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, and wherein amplitude of the protrusion is between about 0.01 mm-2 mm; or between about 0.01 mm-1 mm; or between about 0.01 mm-0.5 mm, or between about 0.01 mm-0.1 mm.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, wherein amplitude of the protrusion is between about 0.01 mm-2 mm; or between about 0.01 mm-1 mm; or between about 0.01 mm-0.5 mm, or between about 0.01 mm-0.1 mm, and wherein wavelength of the amplitude of the protrusion is between about 0.5 mm-50 mm; or between about 0.5 mm-10 mm; or between about 0.5 mm-5 mm.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, and wherein an average thickness of the ionomer membrane is between about 10 um-250 um; or between about 10 um-100 um; or between about 10 um-50 um; between about 20 um-50 um.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, wherein an average thickness of the ionomer membrane is between about 10 um-250 um; or between about 10 um-100 um; or between about 10 um-50 um; between about 20 um-50 um, and wherein amplitude of the protrusion is between about 0.01 mm-2 mm; or between about 0.01 mm-1 mm; or between about 0.01 mm-0.5 mm, or between about 0.01 mm-0.1 mm.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, wherein an average thickness of the ionomer membrane is between about 10 um-250 um; or between about 10 um-100 um; or between about 10 um-50 um; between about 20 um-50 um, wherein amplitude of the protrusion is between about 0.01 mm-2 mm; or between about 0.01 mm-1 mm; or between about 0.01 mm-0.5 mm, or between about 0.01 mm-0.1 mm, and wherein wavelength of the amplitude of the protrusion is between about 0.5 mm-50 mm; or between about 0.5 mm-10 mm; or between about 0.5 mm-5 mm.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, and wherein a ratio of the cross-sectional area of the built-in separator to the nominal cross-sectional area of the IEM is between about 10-70%; or between about 10-60%; or between about 10-50%; or between about 10-40%; or between about 10-30%; or between about 10-20%.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, wherein a ratio of the cross-sectional area of the built-in separator to the nominal cross-sectional area of the IEM is between about 10-70%; or between about 10-60%; or between about 10-50%; or between about 10-40%; or between about 10-30%; or between about 10-20%, and wherein an average thickness of the ionomer membrane is between about 10 um-250 um; or between about 10 um-100 um; or between about 10 um-50 um; between about 20 um-50 um.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, wherein a ratio of the cross-sectional area of the built-in separator to the nominal cross-sectional area of the IEM is between about 10-70%; or between about 10-60%; or between about 10-50%; or between about 10-40%; or between about 10-30%; or between about 10-20%, wherein an average thickness of the ionomer membrane is between about 10 um-250 um; or between about 10 um-100 um; or between about 10 um-50 um; between about 20 um-50 um, and wherein amplitude of the protrusion is between about 0.01 mm-2 mm; or between about 0.01 mm-1 mm; or between about 0.01 mm-0.5 mm, or between about 0.01 mm-0.1 mm.

In some embodiments, there is provided an IEM, comprising: an ionomer membrane with a built-in separator wherein one or more sections of the built-in separator protrude out from at least one surface of the ionomer membrane, wherein an average thickness of the built-in separator is between about 20 um-2000 um; or between about 20 um-1500 um; or between about 20 um-1000 um; or between about 20 um-500 um; or between about 20 um-250 um, wherein a ratio of the cross-sectional area of the built-in separator to the nominal cross-sectional area of the IEM is between about 10-70%; or between about 10-60%; or between about 10-50%; or between about 10-40%; or between about 10-30%; or between about 10-20%, wherein an average thickness of the ionomer membrane is between about 10 um-250 um; or between about 10 um-100 um; or between about 10 um-50 um; between about 20 um-50 um, wherein amplitude of the protrusion is between about 0.01 mm-2 mm; or between about 0.01 mm-1 mm; or between about 0.01 mm-0.5 mm, or between about 0.01 mm-0.1 mm and, and wherein wavelength of the amplitude of the protrusion is between about 0.5 mm-50 mm; or between about 0.5 mm-10 mm; or between about 0.5 mm-5 mm.

In some embodiments, the IEM containing the ionomer membrane provided herein, may be selected such that it can function in an acidic and/or basic or metal ion containing electrolytic solution as appropriate. Other desirable characteristics of the IEM provided herein include high ion selectivity, low ionic resistance, high burst strength, and high stability in an acidic electrolytic solution in a temperature range of room temperature to up to about 150° C. or higher, or an alkaline solution in similar temperature range. In some embodiments, the IEM prevents the transport of the metal ion from the anolyte to the catholyte or vice versa. In some embodiments, a membrane that is stable in the range of 0° C. to 200° C.; 0° C. to 150° C.; 0° C. to 90° C.; or 0° C. to 80° C.; or 0° C. to 70° C.; or 0° C. to 60° C.; or 0° C. to 50° C.; or 0° C. to 40° C., or 0° C. to 30° C., may be used. In some embodiments, it may be useful to utilize an ion-specific ionomer in the IEM that may allow migration of one type of cation but not another; or migration of one type of anion and not another, to achieve a desired product or products in an electrolyte. In some embodiments, the membrane may be stable and functional for a desirable length of time in the system, e.g., several days, weeks or months or years at above noted temperatures.

Typically, the ohmic resistance of the membranes may affect the voltage drop across the anode and cathode, e.g., as the ohmic resistance of the membranes increase, the voltage across the anode and cathode may increase, and vice versa. The IEMs provided herein include, but are not limited to, membranes with relatively low ohmic resistance and relatively high ionic mobility; and/or membranes with relatively high hydration characteristics that increase with temperatures, thus decreasing the ohmic resistance. By selecting ionomers for the membranes with lower ohmic resistance, the voltage drop across the anode and the cathode at a specified temperature can be lowered.

In some embodiments, scattered through ionomer may be ionic channels including acid groups. These ionic channels may extend from the internal surface of the matrix to the external surface and the acid groups may readily bind water in a reversible reaction as water-of-hydration. Consequently, ionomer can be selected to provide a relatively low ohmic and ionic resistance while built-in separator provides improved strength and resistance in the system for a range of operating temperatures.

In some embodiments, the IEM provided herein, such as the CEMs in the electrochemical cell include membranes that have minimal resistance loss, greater than 90% selectivity, and/or high stability in concentrated caustic. In some embodiments, the IEM provided herein, such as the AEMs, in the methods and systems of the invention may be exposed to concentrated metallic salt anolytes and saturated brine stream. In some embodiments, the ionomer in the AEM allows passage of salt ion such as chloride ion from the intermediate chamber or from the catholyte (in the absence of the intermediate chamber) to the anolyte but rejects the metallic ion species from the anolyte to the intermediate chamber or the catholyte. In some embodiments, metallic salts may form various ion species (cationic, anionic, and/or neutral) including but not limited to, $MCl^+$, $MCl_2^-$, $MCl_2^\circ$, $M^{2+}$ etc. and it may be desirable for such complexes to not pass through AEM or to not foul the membranes.

Examples of ionomers for the CEMs include, but not limited to, cationic ionomer including perfluorinated polymer containing anionic groups, for example sulphonic and/or carboxylic groups. However, it may be appreciated that in some embodiments, depending on the need to restrict or allow migration of a specific cation or an anion species between the electrolytes, an ionomer in the CEM that is more restrictive and thus allows migration of one species of cations while restricting the migration of another species of cations may be used as, e.g., a CEM that allows migration of sodium ions into the cathode electrolyte from the anode electrolyte while restricting migration of other ions from the anode electrolyte into the cathode electrolyte, may be used. Similarly, in some embodiments, depending on the need to restrict or allow migration of a specific anion species between the electrolytes, an ionomer in the AEM that is more restrictive and thus allows migration of one species of anions while restricting the migration of another species of anions may be used as, e.g., an AEM that allows migration of chloride ions into the anode electrolyte from the cathode electrolyte while restricting migration of hydroxide ions from the cathode electrolyte into the anode electrolyte, may be used.

In some embodiments, the AEM provided herein, may be substantially resistant to the organic compounds (such as ligands or hydrocarbons such as halohydrocarbons, e.g. ethylene dichloride, chloroethanol, etc. in the anode electrolyte) such that AEM does not interact with the organics and/or the AEM does not react or absorb metal ions. In some embodiments, this may be achieved, for example only, by using a polymer that does not contain a free radical or anion available for reaction with organics or with metal ions. For example only, a fully quarternized amine containing polymer may be used as an AEM.

The ionomers used to make membranes may be easy to cast into films and integrated with the built-in separator. The IEM comprising the ionomer membrane integrated with the built-in separator may be fabricated by any commercially available method. For example, the ionomer may be solubilized in a suitable solvent and cast as a film onto a suitable separator material. Upon solvent evaporation and drying, the built-in separator may lock the ionomer membrane on the surface or within the separator such that one or more sections of the built-in separator protrude out from top and/or bottom surfaces of the ionomer membrane. Post imbibing steps may include tension drying, stretching and hot pressing of the IEM. The built-in separator provides mechanical and chemical stability, while the ionomer membrane provides a high-flux ion exchange path.

Ion Exchange Membrane Attached to the Separator

Figure 5C:
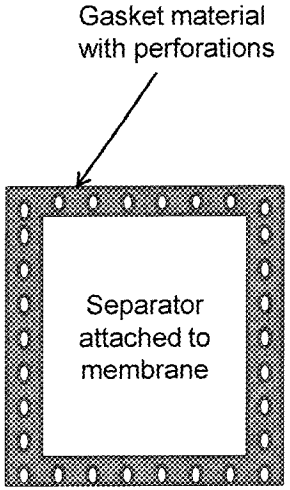
FIGS. 5A-C are an illustration of some embodiments related to a separator component attached to a membrane with or without the gasket material.
Figure 5B:
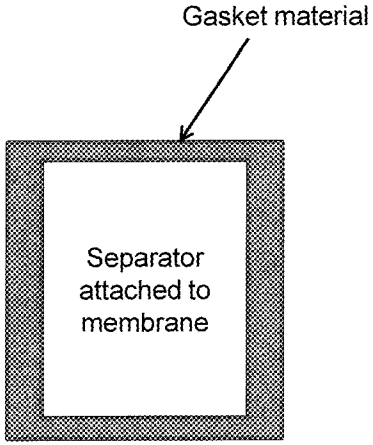
Figure 5A:
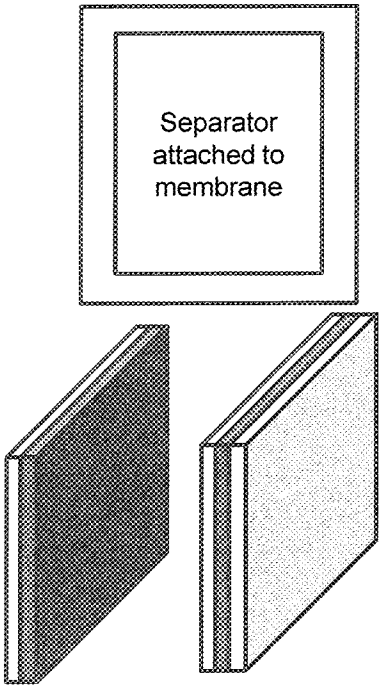

In addition to the IEMs comprising the ionomer membrane and the built-in separator, there are also provided some embodiments where a separator component is attached to the IEM through various techniques, such as, for example only, by fusion, mechanically attached/bonded, or glued. The bonding includes bonding through ultrasonic welding or heat. Any other technique that can be used to attach the separator to the membrane is well within the scope of the invention. Accordingly, in some embodiments, there is provided an IEM assembly comprising an IEM and a separator attached to the membrane. An example of the separator attached to the IEM is illustrated in FIG. 5A. As shown in FIG. 5A, the separator may be attached to one surface of the IEM or both front and back surface of the IEM. The material for the separator is same as the material described above for the built-in separator. The IEMs have also been described herein.

In some embodiments, the separator attached to the membrane is a mesh, cloth, foam, sponge, a planar mesh formed by the overlapping or stacked planes of interwoven fibers or screens, a mattress formed by coils of fibers, an expanded sheet, a plurality of sieves, a plurality of baffles, or a plurality of cascading steps or combinations or juxtapositions of two or more of such elements. In some embodiments, the separator has hydrophobic characteristics or hydrophilic characteristics as is suitable for the cell. The separator may be a corrosion resistant plastic material, such as, for example, a perfluorinated material, e.g., poly-tetrafluoroethylene (PTFE). In some embodiments, the thickness of the separator when the separator is attached to the membrane is between about 0.1 mm to 50 mm, or between about 0.1 mm to 25 mm, or between about 0.1 mm to 15 mm, or between about 0.1 mm to 10 mm, or between about 0.1 mm to 5 mm, or less than 0.1 mm. One skilled in the art would identify preferred thicknesses and geometries of the mesh or cloth depending on the electrolyte density, the height of the hydraulic head to be discharged and/or the required fluid dynamic conditions.

Gasket Material Integrated with One or More Components

In some embodiments of the foregoing aspect and embodiments, the individual components in an electrolyzer, such as the IEM, the individual separator component, the IEM comprising the ionomer membrane integrated with the built-in separator, the IEM attached to the separator, spacers between the components, percolator between the components, the intermediate chamber, etc. further include a gasket material integrated or directly attached to the component. Typically, in the electrolyzers, a gasket frame is an additional component that is used in the assembling of the components of the electrolyzer where the gasket frame is inserted between each of the individual components listed above in order to prevent leakage of the fluid and friction between the components (as described in FIG. 1). Applicants have devised a unique solution to this problem of the multiplicity of the components by integrating the gasket material directly on the frame area of the components such that a separate gasket material is not needed. It reduces the number of components during assembly, saves time and reduces the damages incurred during handling. Further, the printing or the attachment of the gasket material on to the components can improve the rigidity and strength of the components and prevent their distortion during high-pressure conditions. Furthermore, in some embodiments, the attachment of the gasket material on the components can also reduce or eliminate the friction between the components and provide better sealing of the compartments. In some embodiments, the attachment of the gasket material to the electrochemical components may create sufficient gaps or chambers between the components for better fluid flow.

In some embodiments of the foregoing aspect and embodiments, the IEM comprising the ionomer membrane with the built-in separator wherein one or more sections of the built-in separator protrude out from at least one surface of the ionomer membrane, further comprises a gasket material attached to or integrated with the IEM.

The "gasket" or the "gasket material" as used herein, includes a material that provides liquid and/or gas barrier between the components of the electrochemical cell so that before, during and/or after operation of the cell, there is no leakage or minimal leakage between the compartments or outside the cell.

Figure 3A:
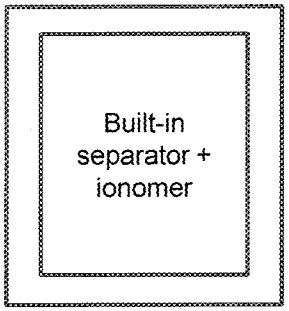
FIGS. 3A-C illustrate some embodiments related to the IEM with an attached gasket material.
Figure 3B:
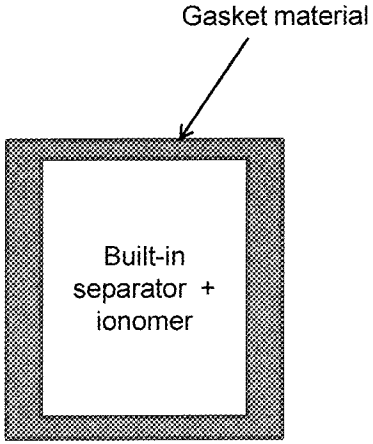
Figure 3C:
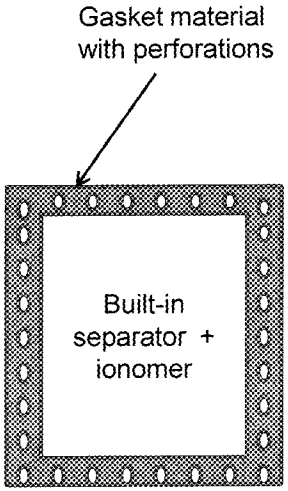

An example of the gasket material integrated with the IEM, where the IEM comprises the ionomer membrane with the built-in separator wherein one or more sections of the built-in separator protrude out from at least one surface of the ionomer membrane, is illustrated in FIGS. 3A-C. FIG. 3A illustrates the IEM comprising the ionomer membrane and the built-in separator and FIG. 3B illustrates the IEM with a gasket material on the edges. The gasket material on the edges is for illustration purposes only. Other configurations of the gasket material such as, but not limited to, patches of the gasket material along the edges, gasket material only at the corners, gasket material on just top and bottom, gasket material on sideways, gasket material on the front and/or back face of the separator or the membrane etc. are all within the scope of the invention. In some embodiments, the gasket material does not contain any structural cuts, such as, holes or perforations (as illustrated in FIG. 3B). In some embodiments, the gasket material contains structural cuts, such as, bolt holes or perforations etc. (as illustrated in FIG. 3C). In some embodiments, the gasket material may be attached on either front, back or both sides of the IEM.

In some embodiments of the foregoing aspects and embodiments, the gasket material may be printed on the components using techniques such as, but not limited to, screen printing, bonding through ultrasonic welding or heat, dipping, polymerization, injection molding, extruding, 3D printing, or digital printing techniques. These techniques are well known in the art.

Figure 4:
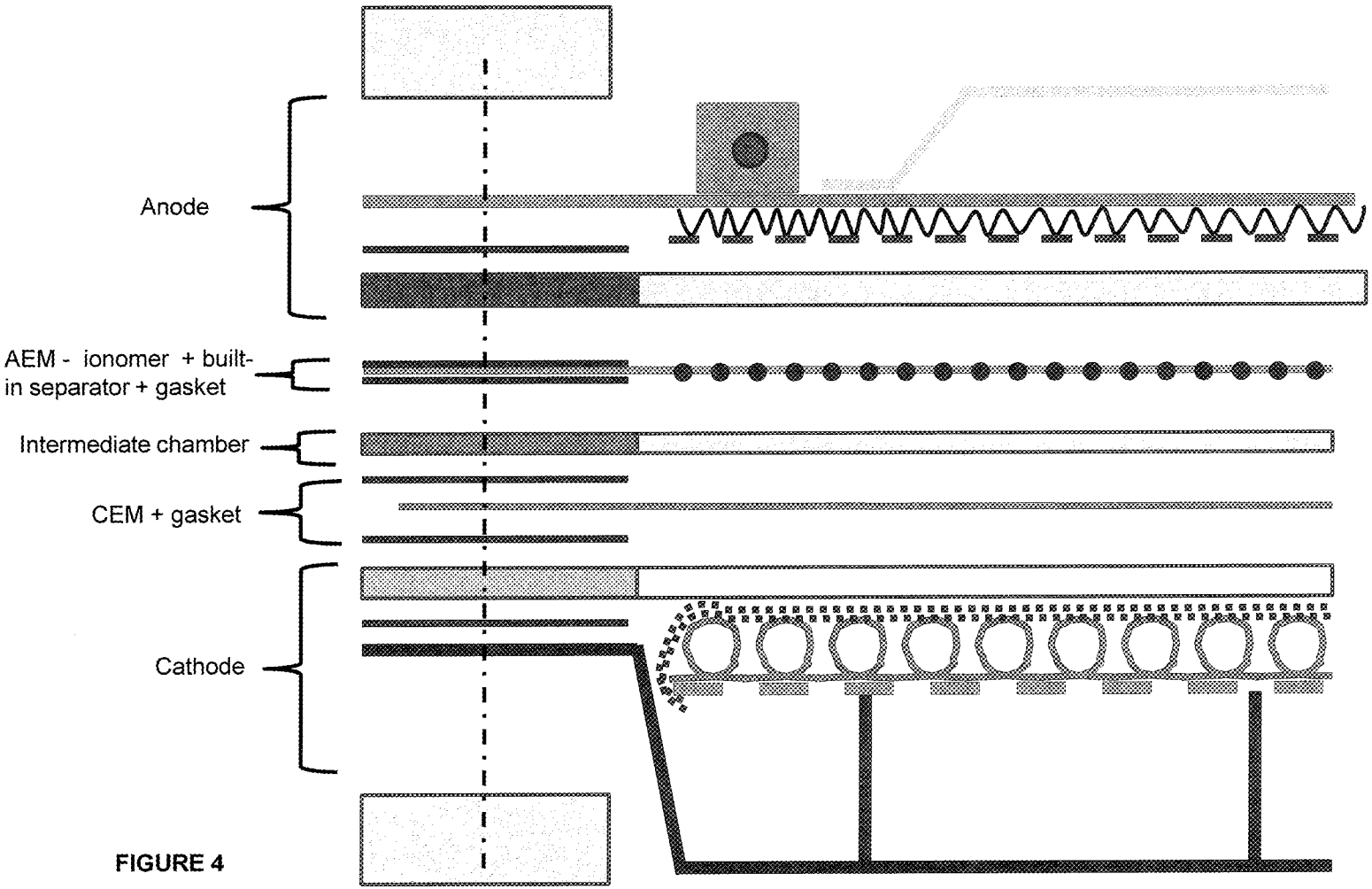
FIG. 4 is an illustration of some embodiments of an electrochemical cell containing the IEM with the ionomer membrane and the built-in separator.

An example of an electrolyzer where the multiplicity of the components is eliminated by integrating the ionomer membrane with the built-in separator to form the IEM, and integrating the gasket material with the IEM, is illustrated in FIG. 4. Compared to the electrolyzer of FIG. 1, where several components had to be assembled (as described before), FIG. 4 illustrates a dramatically reduced number of components as the AEM is one unit comprising the ionomer membrane, the built-in separator, and the gasket material. Further, the CEM is one unit comprising the CEM and the gasket material integrated with the CEM. The integration of the built-in separator with the ionomer membrane eliminates the need for individual separator components and the integration of the gasket material on the IEM eliminates the need for a separate gasket frame. While the CEM is not shown to be integrated with the built-in separator, it is understood that such an embodiment is within the scope of the invention. Additionally, the electrochemical cell may only have an AEM or only have a CEM in the cell where the AEM or the CEM comprises ionomer membrane with the built-in separator.

In addition to the gasket material integrated with the IEM provided herein, the gasket material may be integrated with other individual components, such as, but not limited to, separators, regular IEMs, intermediate chambers, spacers, percolators, etc. Accordingly, in some embodiments, there is provided an IEM assembly comprising an IEM and a gasket material wherein the gasket material is directly attached to or integrated with the IEM. In some embodiments, there is provided a separator comprising a separator and a gasket material wherein the gasket material is directly attached to or integrated with the separator.

In some embodiments, there is provided a percolator comprising a percolator and a gasket material wherein the gasket material is directly attached to or integrated with the percolator. Typically, percolators are components used in the electrochemical cell that are made of porous element that allows liquids to traverse through it. The percolators may assist in even distribution of the anode electrolyte, cathode electrolyte, and/or salt solution depending on its location. The percolator may also assist in providing a mechanical support to the anode, cathode and/or ion exchange membranes. For example, the percolator may help the membrane to be pushed against the anode and/or the cathode with a certain pressure so as to allow the electrical continuity while contributing to the confinement of the circulating liquid electrolyte.

In some embodiments, there is provided a spacer comprising a spacer and a gasket material wherein the gasket material is directly attached to or integrated with the spacer. The spacers are another type of components that may be used in the electrochemical cells that are made of porous elements and allow the liquids to traverse through it. The spacer separate and support the anion exchange membrane and cation exchange membrane. In some embodiments, the spacers are turbulence promoters and are configured in the salt solution to agitate and perturb the salt solution for improved electrical conductivity.

In some embodiments, there is provided an AEM assembly comprising an AEM and a gasket material wherein the gasket material is directly attached to or integrated with the AEM. In some embodiments, there is provided a CEM assembly comprising a CEM and a gasket material wherein the gasket material is directly attached to or integrated with the CEM.

In the foregoing aspects and embodiments, the configurations of the gasket material include such as, but not limited to, patches of the gasket material along the edges, gasket material only at the corners, etc. are all within the scope of the invention. In some embodiments, the gasket material does not contain any structural cuts, such as, holes or perforations. In some embodiments, the gasket material does contain structural cuts, such as, bolt holes or perforations etc. In some embodiments, the gasket material may be attached on either front, back or both sides of the membrane and/or the separator.

As shown in FIG. 5A and explained above, in some embodiments, the separator may be attached to one side of the IEM or both front and back sides of the IEM. In some embodiments, the separator attached to the IEM is further integrated with the gasket material. This embodiment is illustrated in FIG. 5B. In some embodiments, the gasket material does not contain any structural cuts, such as, holes or perforations. In some embodiments, the gasket material does contain structural cuts, such as, bolt holes or perforations etc. (FIG. 5C).

In some embodiments, the separator attached to the IEM or the built-in separator in the IEM, may assist in even distribution of the anode electrolyte, cathode electrolyte, and/or salt solution depending on its location. The separator may also assist in providing a mechanical support to the anode, cathode and/or ion exchange membranes. For example, the separator attached to the membrane may help the membrane to be pushed against the anode and/or the cathode with a desired pressure so as to allow the electrical continuity while providing rigidity and strength to the membrane.

In some embodiments, the separator attached to the IEM or the built-in separator in the IEM may be designed so as to impose a controlled pressure drop to the falling electrolyte column, so that a resulting operative pressure does not flood the electrode but exerts equal pressure on every point. The pressure with which the IEM attached to the separator or the IEM with the built-in separator may be pushed against the anode and/or cathode and/or any other component may be in a range of 0.01 to 2 $kg/cm^2$; or 0.01 to 1.5 $kg/cm^2$; or 0.01 to 1 $kg/cm^2$; or 0.01 to 0.5 $kg/cm^2$; or 0.01 to 0.05 $kg/cm^2$; or 0.1 to 2 $kg/cm^2$; or 0.1 to 1.5 $kg/cm^2$; or 0.1 to 1 $kg/cm^2$; or 0.1 to 0.5 $kg/cm^2$; or 0.5 to 2 $kg/cm^2$; or 0.5 to 1.5 $kg/cm^2$; or 0.5 to 1 $kg/cm^2$; or 1 to 2 $kg/cm^2$; or 1 to 1.5 $kg/cm^2$; or 1.5 to 2 $kg/cm^2$.

In some embodiments of the foregoing aspects and embodiments, the gasket material is attached to the AEM and/or the CEM in the middle thereby creating an intermediate space separating the AEM from the CEM. In some embodiments of the foregoing aspects and embodiments, the gasket material is attached to the AEM attached with the separator or is integrated with the built-in separator. In some embodiments of the foregoing aspects and embodiments, the gasket material is attached to the CEM attached with the separator or is integrated with the built-in separator. In some embodiments of the foregoing aspects and embodiments, the gasket material is attached to the one or more components (such as, the AEM, the CEM, the separator component, the AEM attached to the separator, the AEM integrated with the built-in separator, the CEM attached to the separator, the CEM integrated with the built-in separator, the percolator, the spacer, and/or the intermediate chamber) in design selected from flat sheet or cord sheet. In some embodiments of the foregoing aspects and embodiments, the gasket material can withstand temperature between 25-150° C. or between 40-150° C.

Electrochemical Systems

In another aspect, there is provided an electrochemical system that contains one or more combinations of the above noted components. One example of some embodiments of such electrochemical system has been illustrated in FIG. 4.

In one aspect, there is provided an electrochemical system comprising an anode chamber comprising an anode in contact with an anode electrolyte; a cathode chamber comprising a cathode in contact with a cathode electrolyte; and an ion exchange membrane (IEM), comprising an ionomer membrane with a built-in separator wherein one or more sections of the built-in separator protrude out from at least one surface of the ionomer membrane. In one aspect, there is provided an electrochemical system comprising an anode chamber comprising an anode in contact with an anode electrolyte wherein the anode electrolyte comprises metal ions; a cathode chamber comprising a cathode in contact with a cathode electrolyte; and an ion exchange membrane (IEM), comprising an ionomer membrane with a built-in separator wherein one or more sections of the built-in separator protrude out from at least one surface of the ionomer membrane. Various embodiments related to the material of construction and the configuration of the ionomer membrane as well as the built-in separator including the average thickness of the built-in separator, the dimensions of the amplitude of the protrusion, the wavelength or the pitch of the amplitude of the protrusion, the average thickness of the ionomer membrane, and the cross sectional area of the built-in separator to the nominal cross-sectional area of the IEM, have been described herein and all of those configurations are applicable to the foregoing electrochemical systems. In the foregoing aspects, in some embodiments, the anode is configured to oxidize the metal ions from a lower oxidation state to a higher oxidations state. For example, in some embodiments, the anode is configured to oxidize copper ions from Cu(I)Cl to $Cu(II)Cl_2$.

Further, in one aspect, there is provided an electrochemical system comprising an anode chamber comprising an anode in contact with an anode electrolyte; a cathode chamber comprising a cathode in contact with a cathode electrolyte; and one or more components selected from the group consisting of anion exchange membrane (AEM), cation exchange membrane (CEM), intermediate chamber between the AEM and the CEM, separator, separator attached to the AEM, separator attached to the CEM, separator attached to both the AEM and the CEM in middle, the AEM attached to the CEM, AEM integrated with a built-in separator, CEM integrated with a built-in separator, percolator, spacer, and combinations thereof, wherein the one or more components are integrated with gasket material. In some embodiments, there is provided an electrochemical system comprising an anode chamber comprising an anode in contact with an anode electrolyte; a cathode chamber comprising a cathode in contact with a cathode electrolyte; and one or more components selected from the group consisting of separator attached to the AEM, separator attached to the CEM, AEM integrated with a built-in separator, CEM integrated with a built-in separator, and combinations thereof, wherein the one or more components are integrated with gasket material.

The materials, dimensions, and designs of the gasket material have been described in detail herein and all the details related to the gasket material are applicable to the electrochemical systems containing those gasket material integrated with the one or more components. In some embodiments of the foregoing aspect, the anode electrolyte comprises metal ions and the anode is configured to oxidize the metal ions from a lower oxidation state to the higher oxidations state.

Examples of the metal ions include, without limitation, copper ions, platinum ions, tin ions, chromium ions, iron ions etc. The metal ions may be present as a metal halide or a metal sulfate.

In some embodiments of the foregoing, the one or more components comprise a gasket material directly attached to the one or more components. The electrochemical cell or system has been illustrated in FIGS. 1 and 4, where the cell houses an anode and an anode electrolyte in the anode chamber and a cathode and a cathode electrolyte in the cathode chamber. The two chambers may be separated by an IEM (such as AEM or CEM with or without the attached separator or the built-in separator); an optional intermediate chamber; and/or separator either independently or attached to the AEM or the CEM. Many such combinations are possible and are within the scope of the invention. However, all the components need not be present in the cell as the cell may individually have the AEM with the built-in separator, the AEM with the separator attached, the CEM with the built-in separator, the CEM with the separator attached, an intermediate chamber with or without the separator, and any component with and without the gasket material, etc.

The electrochemical cell provided herein may be any electrochemical cell that uses an IEM. The reactions in the electrochemical cell using the components of the invention may be any reaction carried out in the electrochemical cell including but not limited to chlor-alkali processes. In some embodiments, the electrochemical cell has an anode electrolyte containing metal ions and the anode oxidizes the metal ions from the lower oxidation state to the higher oxidation state in the anode chamber. Such electrochemical cells have been described in detail in US Patent Application Publication No. 2012/0292196, filed May 17, 2012, which is incorporated herein by reference in its entirety.

In the electrochemical cells provided herein, the cathode reaction may be any reaction that does or does not form an alkali in the cathode chamber. Such cathode consumes electrons and carries out any reaction including, but not limited to, the reaction of water to form hydroxide ions and hydrogen gas; or reaction of oxygen gas and water to form hydroxide ions; or reduction of protons from an acid such as hydrochloric acid to form hydrogen gas; or reaction of protons from hydrochloric acid and oxygen gas to form water. In some embodiments, the electrochemical cells may include production of alkali in the cathode chamber of the cell.

The electron(s) generated at the anode are used to drive the reaction at the cathode. The cathode reaction may be any reaction known in the art. The anode chamber and the cathode chamber are separated by the IEM provided herein that may allow the passage of ions, such as, but not limited to, sodium ions in some embodiments to the cathode electrolyte if the anode electrolyte is sodium chloride, sodium bromide, sodium iodide, sodium sulfate; or ammonium ions if the anode electrolyte is ammonium chloride etc.; or an equivalent solution containing metal halide.

In some embodiments, the IEM allows the passage of anions, such as, but not limited to, chloride ions, bromide ions, iodide ions, or sulfate ions to the anode electrolyte if the cathode electrolyte is e.g., sodium chloride, sodium bromide, sodium iodide, or sodium sulfate or an equivalent solution. The sodium ions combine with hydroxide ions in the cathode electrolyte to form sodium hydroxide. The anions combine with metal ions in the anode electrolyte to form metal halide or metal sulfate.

In some embodiments of the electrochemical cell, a third electrolyte (e.g., sodium chloride, sodium bromide, sodium iodide, sodium sulfate, ammonium chloride, HCl, or combinations thereof or an equivalent solution) is disposed between the AEM (attached to the separator or integrated with the built-in separator) and the CEM (attached to the separator or integrated with the built-in separator) or in the intermediate chamber between the AEM and the CEM. The ions, e.g. sodium ions, from the third electrolyte pass through CEM to form sodium hydroxide in the cathode chamber and the halide anions such as, chloride, bromide or iodide ions, or sulfate anions, from the third electrolyte pass through the AEM to form HCl or a solution for metal halide or metal sulfate in the anode chamber. The third electrolyte, after the transfer of the ions, can be withdrawn from the middle chamber as depleted ion solution. For example, in some embodiments when the third electrolyte is sodium chloride solution, then after the transfer of the sodium ions to the cathode electrolyte and transfer of chloride ions to the anode electrolyte, the depleted sodium chloride solution may be withdrawn from the middle chamber.

The electrochemical cells in the methods and systems provided herein are membrane electrolyzers. The electrochemical cell may be a single cell or may be a stack of cells connected in series or in parallel. The electrochemical cell may be a stack of 5 or 6 or 50 or 100 or more electrolyzers connected in series or in parallel. Each cell comprises an anode, a cathode, an ion exchange membrane, and optionally a separator, as illustrated in the figures. In some embodiments, the electrolyzers provided herein are monopolar electrolyzers. In the monopolar electrolyzers, the electrodes may be connected in parallel where all anodes and all cathodes are connected in parallel. In such monopolar electrolyzers, the operation takes place at high amperage and low voltage. In some embodiments, the electrolyzers provided herein are bipolar electrolyzers. In the bipolar electrolyzers, the electrodes may be connected in series where all anodes and all cathodes are connected in series. In such bipolar electrolyzers, the operation takes place at low amperage and high voltage. In some embodiments, the electrolyzers are a combination of monopolar and bipolar electrolyzers and may be called hybrid electrolyzers.

In some embodiments of the bipolar electrolyzers as described above, the cells are stacked serially constituting the overall electrolyzer and are electrically connected in two ways. In bipolar electrolyzers, a single plate, called bipolar plate, may serve as base plate for both the cathode and anode. The electrolyte solution may be hydraulically connected through common manifolds and collectors internal to the cell stack. The stack may be compressed externally to seal all frames and plates against each other, which are typically referred to as a filter press design. In some embodiments, the bipolar electrolyzer may also be designed as a series of cells, individually sealed, and electrically connected through back-to-back contact, typically known as a single element design. The single element design may also be connected in parallel in which case it would be a monopolar electrolyzer.

In some embodiments, the anode used in the electrochemical systems may contain a corrosion stable base support. Other examples of base materials include, but not limited to, sub-stoichiometric titanium oxides, such as, Magneli phase sub-stoichiometric titanium oxides having the formula $TiO_x$ wherein x ranges from about 1.67 to about 1.9. Some examples of titanium sub-oxides include, without limitation, titanium oxide $Ti_4O_7$. The base materials also include, without limitation, metal titanates such as $M_xTi_yO_z$ such as $M_xTi_4O_7$, etc.

In some embodiments, the anode is not coated with an electrocatalyst. In some embodiments, the electrodes described herein (including anode and/or cathode) contain an electrocatalyst for aiding in electrochemical dissociation, e.g. reduction of oxygen at the cathode or the oxidation of the metal ion at the anode. Examples of electrocatalysts include, but not limited to, highly dispersed metals or alloys of the platinum group metals, such as platinum, palladium, ruthenium, rhodium, iridium, or their combinations such as platinum-rhodium, platinum-ruthenium, titanium mesh coated with PtIr mixed metal oxide or titanium coated with galvanized platinum; electrocatalytic metal oxides, such as, but not limited to, $IrO_2$; silver, gold, tantalum, carbon, graphite, organometallic macrocyclic compounds, and other electrocatalysts well known in the art for electrochemical reduction of oxygen or oxidation of metal.

In some embodiments, the electrodes described herein, relate to porous homogeneous composite structures as well as heterogeneous, layered type composite structures wherein each layer may have a distinct physical and compositional make-up, e.g. porosity and electroconductive base to prevent flooding, and loss of the three phase interface, and resulting electrode performance.

Any of the cathodes provided herein can be used in combination with any of the anodes described above. In some embodiments, the cathode used in the electrochemical systems of the invention, is a hydrogen gas producing cathode. In some embodiments, the cathode used in the electrochemical systems of the invention, is a hydrogen gas producing cathode that does not form an alkali. The hydrogen gas may be vented out or captured and stored for commercial purposes. In some embodiments, the cathode in the electrochemical systems of the invention may be a gas-diffusion cathode. In some embodiments, the gas-diffusion cathode, as used herein, is an oxygen depolarized cathode (ODC). The oxygen at the cathode may be atmospheric air or any commercial available source of oxygen. In some embodiments, the cathode in the electrochemical systems of the invention may be a gas-diffusion cathode that reacts HCl and oxygen gas to form water. The oxygen at the cathode may be atmospheric air or any commercial available source of oxygen.

In some embodiments, the electrolyte in the electrochemical systems and methods described herein include the aqueous medium containing more than 1 wt % water. In some embodiments, the aqueous medium includes more than 1 wt % water; more than 5 wt % water; or more than 5.5 wt % water; or more than 6 wt %; or more than 20 wt % water; or more than 25 wt % water. In some embodiments, the aqueous medium may comprise an organic solvent such as, e.g. water soluble organic solvent.

In some embodiments of the methods and systems described herein, the amount of total metal ion in the anode electrolyte or the amount of copper in the anode electrolyte or the amount of iron in the anode electrolyte or the amount of chromium in the anode electrolyte or the amount of tin in the anode electrolyte or the amount of platinum is between 1-12M; or between 1-11M; or between 1-10M; or between 1-9M; or between 1-8M; or between 1-7M; or between 1-6M; or between 1-5M; or between 1-4M; or between 1-3M; or between 1-2M. In some embodiments, the amount of total ion in the anode electrolyte, as described above, is the amount of the metal ion in the lower oxidation state plus the amount of the metal ion in the higher oxidation state; or the total amount of the metal ion in the higher oxidation state; or the total amount of the metal ion in the lower oxidation state.

In some embodiments of the methods and systems described herein, the anode electrolyte in the electrochemical systems and methods provided herein contains the metal ion in the higher oxidation state in the range of 4-7M, the metal ion in the lower oxidation state in the range of 0.1-2M and sodium chloride in the range of 1-3M. The anode electrolyte may optionally contain 0.01-0.1M hydrochloric acid. In some embodiments of the methods and systems described herein, the anode electrolyte may contain another cation in addition to the metal ion. Other cation includes, but is not limited to, alkaline metal ions and/or alkaline earth metal ions, such as but not limited to, lithium, sodium, calcium, magnesium, etc. The amount of the other cation added to the anode electrolyte may be between 0.01-5M; or between 0.01-1M; or between 0.05-1M; or between 0.5-2M; or between 1-5M.

In some embodiments, the aqueous electrolyte including the catholyte or the cathode electrolyte and/or the anolyte or the anode electrolyte, or the third electrolyte disposed between AEM and CEM, in the systems and methods provided herein include, but not limited to, saltwater or fresh water. The saltwater includes, but is not limited to, seawater, brine, and/or brackish water. Saltwater is employed in its conventional sense to refer to a number of different types of aqueous fluids other than fresh water, where the saltwater includes, but is not limited to, brine as well as other salines having a salinity that is greater than that of freshwater. Brine is water saturated or nearly saturated with salt and has a salinity that is 50 ppt (parts per thousand) or greater.

In some embodiments, the electrolyte including the cathode electrolyte and/or the anode electrolyte and/or the third electrolyte, such as, saltwater include water containing more than 1% chloride content, e.g. alkali metal halides including sodium halide, potassium halide etc. e.g. more than 1% NaCl; or more than 10% NaCl; or more than 50% NaCl; or more than 70% NaCl; or between 1-99% NaCl; or between 1-70% NaCl; or between 1-50% NaCl; or between 1-10% NaCl; or between 10-99% NaCl; or between 10-50% NaCl; or between 20-99% NaCl; or between 20-50% NaCl; or between 30-99% NaCl; or between 30-50% NaCl; or between 40-99% NaCl; or between 40-50% NaCl; or between 50-90% NaCl; or between 60-99% NaCl; or between 70-99% NaCl; or between 80-99% NaCl; or between 90-99% NaCl; or between 90-95% NaCl. In some embodiments, the above recited percentages apply to ammonium chloride, ferric chloride, sodium bromide, sodium iodide, or sodium sulfate as an electrolyte. The percentages recited herein include wt % or wt/wt % or wt/v %. It is to be understood that all the electrochemical systems described herein that contain sodium chloride can be replaced with other suitable electrolytes, such as, but not limited to, ammonium chloride, sodium bromide, sodium iodide, sodium sulfate, potassium salts, or combination thereof.

As used herein, the "voltage" includes a voltage or a bias applied to or drawn from an electrochemical cell that drives a desired reaction between the anode and the cathode in the electrochemical cell. In some embodiments, the desired reaction may be the electron transfer between the anode and the cathode such that an alkaline solution, water, or hydrogen gas is formed in the cathode electrolyte and the metal ion is oxidized at the anode. In some embodiments, the desired reaction may be the electron transfer between the anode and the cathode such that the metal ion in the higher oxidation state is formed in the anode electrolyte from the metal ion in the lower oxidation state. The voltage may be applied to the electrochemical cell by any means for applying the current across the anode and the cathode of the electrochemical cell. Such means are well known in the art and include, without limitation, devices, such as, electrical power source, fuel cell, device powered by sun light, device powered by wind, and combinations thereof. The type of electrical power source to provide the current can be any power source known to one skilled in the art. For example, in some embodiments, the voltage may be applied by connecting the anodes and the cathodes of the cell to an external direct current (DC) power source. The power source can be an alternating current (AC) rectified into DC. The DC power source may have an adjustable voltage and current to apply a requisite amount of the voltage to the electrochemical cell.

Methods

In another aspect, there are provided methods to use the IEMs, the one or more components described herein, and/or the electrochemical systems provided herein.

In one aspect, there is provided an electrochemical method, comprising:

applying a voltage between an anode and a cathode;

contacting the anode with an anode electrolyte;

contacting the cathode with a cathode electrolyte;

contacting the anode electrolyte with an IEM comprising an ionomer membrane with a built-in separator and/or contacting the cathode electrolyte with an IEM comprising an ionomer membrane with a built-in separator, wherein one or more sections of the built-in separator protrude out from at least one surface of the IEM.

In one aspect, there is provided an electrochemical method, comprising:

applying a voltage between an anode and a cathode;

contacting the anode with an anode electrolyte wherein the anode electrolyte comprises metal ions and the anode oxidizes the metal ions from a lower oxidation state to a higher oxidation state;

contacting the cathode with a cathode electrolyte;

contacting the anode electrolyte with an IEM comprising an ionomer membrane with a built-in separator and/or contacting the cathode electrolyte with an IEM comprising an ionomer membrane with a built-in separator, wherein one or more sections of the built-in separator protrude out from at least one surface of the IEM.

In the foregoing aspects, amplitude of the protrusion is between about 0.01 mm-1 mm; or between about 0.01 mm-0.5 mm, or between about 0.01 mm-0.1 mm;

wavelength (or pitch) of the amplitude of the protrusion is between about 0.5 mm-50 mm; or between about 0.5 mm-10 mm; or between about 0.5 mm-5 mm;

an average thickness of the built-in separator is between about 20 um-2000 um; or between about 20 um-1500 um; or between about 20 um-1000 um; or between about 20 um-500 um; or between about 20 um-250 um;

an average thickness of the ionomer membrane is between about 10 um-250 um; or between about 10 um-100 um; or between about 10 um-50 um; or between about 20 um-50 um; and/or a ratio of cross-sectional area of the built-in separator to the nominal cross-sectional area of the IEM is between about 5-70%; or between about 5-50%; or between about 5-30%; or between about 10-30%.

Any combination of the above noted dimensions may be incorporated in the foregoing aspects. In some embodiments as noted above, the built-in separator provides rigidity to the IEM and eliminates a need for an additional separator component. The one or more sections of the built-in separator protrude out from front and/or back surfaces of the IEM.

In some embodiments of the foregoing aspect and embodiments, the amplitude of the protrusion is between about 0.01 mm-1 mm. One or more of the embodiments related to the average thickness of the built-in separator, the amplitude of the protrusion, the wavelength of the amplitude of the protrusion, the average thickness of the membrane, and the cross-sectional area of the built-in separator to the nominal cross-sectional area of the IEM are applicable to the methods provided herein. In some embodiments of the foregoing aspect and embodiments, the built-in separator separates the IEM from the anode; separates the IEM from the cathode; separates the IEM from another IEM; or combinations thereof.

In some embodiments of the foregoing aspect and embodiments, the method further comprises integrating a gasket material to the IEM. In some embodiments of the foregoing aspect and embodiments, the method further comprises integrating the gasket material by screen printing, bonding through ultrasonic welding or heat, dipping, polymerization, injection molding, extruding, 3D printing, or digital printing.

In some embodiments of the foregoing aspect and embodiments, the gasket material integrated to the IEM imparts rigidity and strength to the IEM and eliminates a need for a separate gasket component.

In one aspect, there is provided a method, comprising attaching a gasket material to an ion exchange membrane wherein the gasket material is directly attached to or integrated with the ion exchange membrane. In one aspect, there is provided a method, comprising attaching a gasket material to a percolator wherein the gasket material is directly attached to or integrated with the percolator. In one aspect, there is provided a method, comprising attaching a gasket material to a spacer wherein the gasket material is directly attached to or integrated with the spacer. In one aspect, there is provided a method, comprising attaching a gasket material to a separator wherein the gasket material is directly attached to or integrated with the separator. The gasket material, the separator, the percolator, the spacer, and the IEM have been described in detail above.

In one aspect, there is provided a method, comprising attaching a separator to an ion exchange membrane. The separator may be attached to the membrane using techniques, such as, but not limited to, fusion, mechanically attached, or glued. The separator and the ion exchange membranes have been described in detail above. In all the above aspects, the gasket material may be attached to one or more components to provide rigidity and strength while minimizing the number of individual gasket material to be used between the components. Various techniques may be used to attach the gasket material to the membrane and/or the separator such as, but not limited to, screen printing, bonding through ultrasonic welding or heat, dipping, polymerization, injection molding, extruding, 3D printing, digital printing etc.

Accordingly, in one aspect, there is provided a method, comprising contacting an anode with an anode electrolyte;

contacting a cathode with a cathode electrolyte;

contacting the anode electrolyte with an AEM, a separator, both the AEM and the separator, separator attached to AEM, or AEM comprising ionomer membrane and a built-in separator;

contacting the cathode electrolyte with CEM, a separator, both the CEM and the separator, separator attached to CEM, or CEM comprising ionomer membrane and a built-in separator;

optionally contacting the anode electrolyte and the cathode electrolyte with an intermediate chamber, and attaching a gasket material to the AEM, the CEM, the separator, the separator attached to the AEM, the AEM comprising ionomer membrane and the built-in separator, the separator attached to the CEM, the CEM comprising ionomer membrane and the built-in separator, and/or the intermediate chamber.

In some embodiments of the foregoing aspect, the AEM or the CEM comprising ionomer membrane and the built-in separator has one or more sections of the built-in separator protrude out from at least one surface of the ionomer membrane. In some embodiments, the method further comprises attaching the gasket material by screen printing, bonding through ultrasonic welding or heat, dipping, polymerization, injection molding, extruding, 3D printing, or digital printing. In some embodiments, the method further comprises attaching the gasket material to the edges of the AEM, the CEM, the separator, the separator attached to the AEM, the AEM comprising ionomer membrane and the built-in separator, the separator attached to the CEM, the CEM comprising ionomer membrane and the built-in separator, and/or the intermediate chamber. In some embodiments, the method comprises attaching the gasket material to the AEM. In some embodiments, the method comprises attaching the gasket material to the CEM. In some embodiments, the method comprises attaching the gasket material to the intermediate chamber. In some embodiments, the method comprises attaching the gasket material to the separator. In some embodiments, the method further comprises separating the AEM from the anode using the separator; separating the CEM from the cathode using the separator; separating the AEM from the CEM; or combinations thereof. In some embodiments, the anode electrolyte comprises metal ions and the method further comprises oxidizing the metal ions from a lower oxidation state to a higher oxidation state at the anode The following examples are put forth so as to provide those of ordinary skill in the art with a complete disclosure and description of how to make and use the present invention, and are not intended to limit the scope of what the inventors regard as their invention nor are they intended to represent that the experiments below are all or the only experiments performed. Various modifications of the invention in addition to those described herein will become apparent to those skilled in the art from the foregoing description and accompanying figures. Such modifications fall within the scope of the appended claims. Efforts have been made to ensure accuracy with respect to numbers used (e.g. amounts, temperature, etc.) but some experimental errors and deviations should be accounted for. Unless indicated otherwise, parts are parts by weight, molecular weight is weight average molecular weight, temperature is in degrees Centigrade, and pressure is at or near atmospheric.

EXAMPLES

Example 1

Electrochemical System with Components and Gasket Material

This example illustrates the assembly of the components in a typical electrochemical cell. The electrochemical cell was built up layer by layer from the anode. Guide pins inserted through the anode's flange enabled alignment of each subsequent layer. The build sequence was as follows. As illustrated in FIG. 1, added gasket above the anode assembly if the separator frame was included in the assembly. Added separator frame if desired. Added gasket. Added AEM. Added gasket (this gasket might include integral brine gap separator). Added intermediate chamber/frame. Added gasket. Added CEM. Added gasket if cathode separator frame was utilized. Added cathode separator frame if desired. Added gasket. Added cathode. Added flange bars. Bolted cell flanges together to produce sealed cell.

In operation, the anolyte was a metallic salt of mixed oxidation state such as $CuCl_2$ and CuCl in which the $Cu^{1+}$ was oxidized at the anode to $Cu^{2+}$. At the cathode, water was reduced to form hydroxide ion and hydrogen gas. Brine was fed into the intermediate chamber and maintained charge balance by transferring chloride ions across the anion exchange membrane and sodium ions across the cation exchange membranes.

By attaching/integrating the various components as described in the invention, such as, attaching the gasket material to the one or more components, attaching the separator or integrating the built-in separator to the AEM or the CEM, etc. the number of components needed for the electrochemical assembly can be reduced to improve ease of assembly, efficiency, and cost.

Example 2

IEM with an Ionomer Membrane and Built-in Separator

An impedance study was conducted to measure the through-plane area resistance of the AEM membranes with the built-in separators. The first AEM membrane built by integrating an ionomer solution with the built-in separator was produced by a casting method in which an ionomer solution was cast within a PET (polyethylene terephthalate) woven reinforcement. The first AEM membrane composed of the ionomer membrane and the built-in separator (made of PET) of the same thickness with no protrusion of the built-in separator. The second membrane (built by the same process as above) had the same built-in separator as the first membrane but a reduced ionomer thickness so that one or more sections of the built-in separator were protruding out from the ionomer membrane surface. Various ionomer membrane thicknesses for the IEMs integrated with the built-in separator have been described herein.

The impedance test parameters included a direct current of 10 mA, an alternating current of 5 mA, and a frequency sweep of 100,000 Hz to 10 Hz. The test solution was 0.5N NaCl at a temperature of 25° C.

Figure 6:
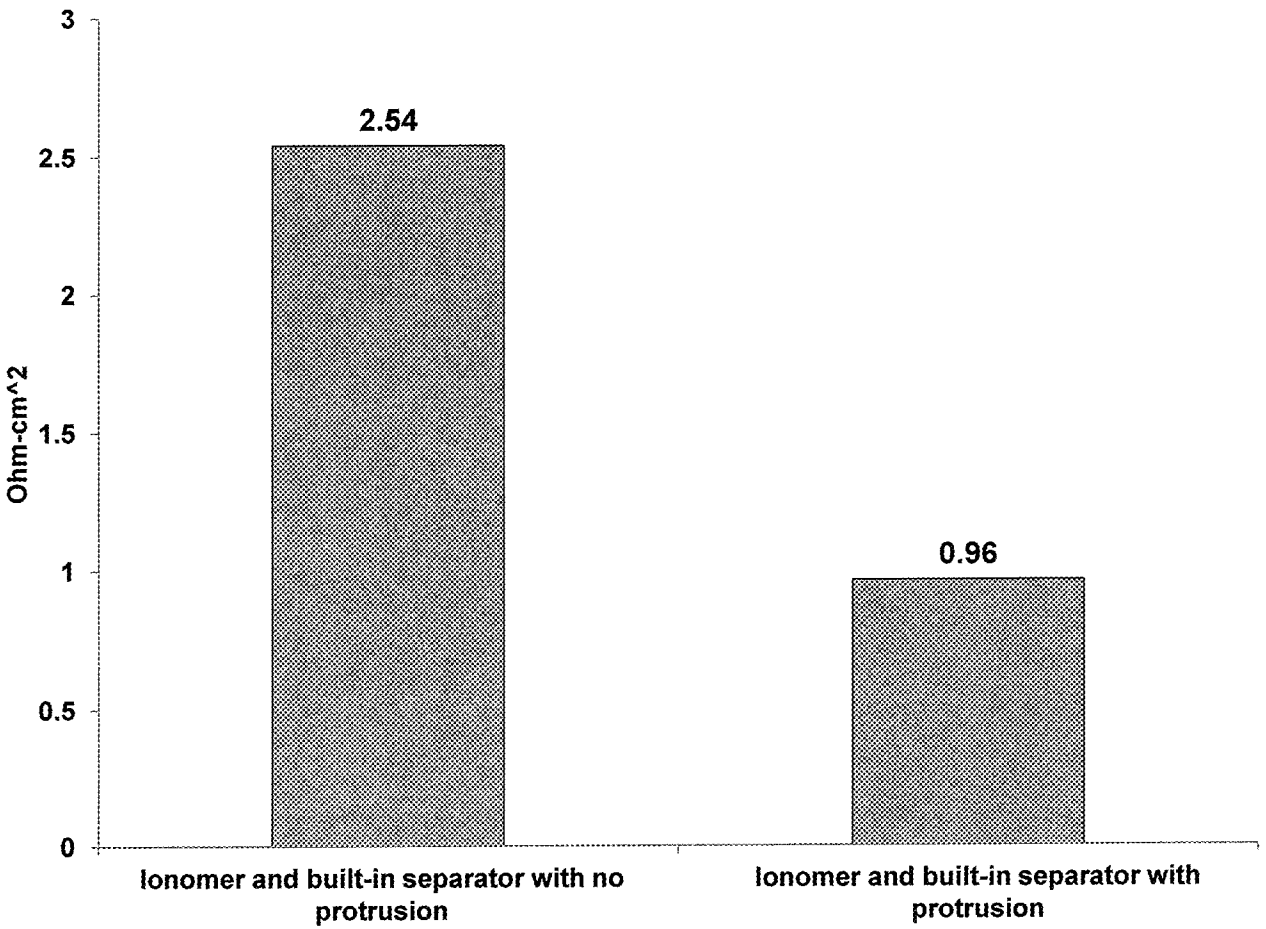
FIG. 6 is data related to an experiment described in Example 2.

The test results showed that the first AEM membrane that had no protrusion of the built-in separator had higher through-plane area resistance than the second membrane with the reduced ionomer membrane thickness (FIG. 6) and with protrusion of the built-in separator. Reducing only the ionomer membrane thickness layer in the second AEM membrane significantly lowered the through-plane area resistance while enhancing the surface stability via the protruding sections of the built-in separator. The protrusions of the built-in separator also provided regions of thorough mixing of the anolyte which benefited both AEM ion transport and the anodic reaction and reduce the area resistance.

What is claimed is:

1. An electrochemical method, comprising:

applying a voltage between an anode and a cathode;

contacting the anode with an anode electrolyte wherein the anode electrolyte comprises metal ions and the anode oxidizes the metal ions from a lower oxidation state to a higher oxidation state;

contacting the cathode with a cathode electrolyte;

contacting the anode electrolyte with an ion exchange membrane (IEM) comprising an ionomer membrane with a built-in separator and/or contacting the cathode electrolyte with an IEM comprising an ionomer membrane with a built-in separator, wherein one or more sections of the built-in separator protrude out from front and back surfaces of the ionomer membrane, wherein the built-in separator is a mesh.

2. The method of claim 1, wherein the built-in separator provides rigidity to the IEM and eliminates a need for an additional separator component.

3. The method of claim 1, wherein amplitude of the protrusion is from 0.02 mm to 1 mm.

4. The method of claim 1, wherein the built-in separator separates the IEM from the anode; separates the IEM from the cathode; separates the IEM from another IEM; or combinations thereof.

5. The method of claim 1, further comprising integrating a gasket material to the IEM.

6. The method of claim 5, further comprising integrating the gasket material by a method selected from the group consisting of screen printing, bonding through ultrasonic welding or heat, dipping, polymerization, injection molding, extruding, 3D printing, or digital printing.

7. The method of claim 5, wherein the gasket material integrated to the IEM imparts rigidity and strength to the IEM and eliminates a need for a separate gasket component.

8. The method of claim 3, wherein wavelength of the amplitude of the protrusion is from 0.5 mm to 50 mm.

9. The method of claim 1, wherein an average thickness of the ionomer membrane is from 10 μm to 250 μm.

10. The method of claim 1, wherein the built-in separator is made of polypropylene.

* * * * *